US006298824B1

(12) United States Patent
Suhre

(10) Patent No.: US 6,298,824 B1
(45) Date of Patent: Oct. 9, 2001

(54) ENGINE CONTROL SYSTEM USING AN AIR AND FUEL CONTROL STRATEGY BASED ON TORQUE DEMAND

(75) Inventor: Blake R. Suhre, Neenah, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/422,614

(22) Filed: Oct. 21, 1999

(51) Int. Cl.[7] ..... F02P 5/00
(52) U.S. Cl. ..... 123/406.49; 123/406.52
(58) Field of Search ..... 123/361, 406.52, 123/406.49, 406.47

(56) References Cited

U.S. PATENT DOCUMENTS

| | | | | |
|---|---|---|---|---|
| Re. 34,803 | | 12/1994 | Chasteen | 123/73 |
| 4,779,581 | | 10/1988 | Maier | 123/73 |
| 4,883,035 | * | 11/1989 | Shimomura et al. | 123/361 |
| 4,955,346 | * | 9/1990 | Kaneyasu et al. | 123/361 |
| 5,372,110 | * | 12/1994 | Boverie et al. | 123/361 |
| 5,433,283 | * | 7/1995 | Shultz et al. | 123/361 |
| 5,619,967 | * | 4/1997 | Streib | 123/406.52 |
| 5,626,120 | | 5/1997 | Akatsuka | 123/479 |
| 5,749,344 | | 5/1998 | Yoshiume et al. | 123/399 |
| 5,813,374 | | 9/1998 | Chasteen | 123/73 |
| 5,848,582 | | 12/1998 | Ehlers et al. | 123/486 |
| 6,003,492 | * | 12/1999 | Muto et al. | 123/361 |

* cited by examiner

*Primary Examiner*—John Kwon
(74) *Attorney, Agent, or Firm*—William D. Lanyi

(57) ABSTRACT

A control system for a fuel injected engine provides an engine control unit that receives signals from a throttle handle that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle handle and the throttle plate. All operating parameters are either calculated as a function of ambient conditions or determined by selecting parameters from matrices which allow the engine control unit to set the operating parameters as a function of engine speed and torque demand, as represented by the position of the throttle handle.

13 Claims, 7 Drawing Sheets

942 944 TORQUE DEMAND (%)

| ENGINE SPEED (RPM) | 0 | 3 | 6 | 9 | 13 | 16 | 19 | 22 | 25 | 28 | 31 | 34 | 38 | 41 | 44 | 47 | 50 | 53 | 56 | 59 | 63 | 66 | 69 | 72 | 75 | 78 | 81 | 84 | 88 | 91 | 94 | 97 | 100 |
|---|---|---|---|---|---|---|---|---|---|---|---|---|---|---|---|---|---|---|---|---|---|---|---|---|---|---|---|---|---|---|---|---|---|
| 400 | 23 | 26 | 30 | 30 | 30 | 30 | 30 | 30 | 30 | 28 | 28 | 28 | 28 | 28 | 22 | 22 | 20 | 20 | 20 | 19 | 20 | 21 | 21 | 22 | 22 | 16 | 16 | 16 | 16 | 16 | 16 | 16 | 16 |
| 500 | 23 | 26 | 30 | 30 | 30 | 30 | 30 | 30 | 30 | 28 | 28 | 28 | 28 | 28 | 22 | 22 | 20 | 20 | 20 | 19 | 20 | 21 | 21 | 22 | 22 | 16 | 16 | 16 | 16 | 16 | 16 | 16 | 16 |
| 600 | 23 | 26 | 30 | 30 | 30 | 30 | 30 | 30 | 30 | 28 | 28 | 28 | 28 | 28 | 22 | 22 | 20 | 20 | 20 | 19 | 20 | 21 | 21 | 22 | 22 | 16 | 16 | 16 | 16 | 16 | 16 | 16 | 16 |
| 700 | 25 | 30 | 30 | 30 | 30 | 30 | 30 | 30 | 30 | 28 | 28 | 28 | 28 | 28 | 22 | 22 | 20 | 20 | 20 | 19 | 20 | 21 | 21 | 22 | 22 | 16 | 16 | 16 | 16 | 16 | 16 | 16 | 16 |
| 800 | 27 | 30 | 30 | 30 | 30 | 30 | 30 | 29 | 29 | 28 | 28 | 28 | 28 | 28 | 22 | 22 | 20 | 20 | 20 | 19 | 20 | 21 | 21 | 22 | 22 | 16 | 16 | 16 | 16 | 16 | 16 | 16 | 16 |
| 900 | 29 | 32 | 32 | 32 | 30 | 30 | 29 | 28 | 27 | 27 | 26 | 26 | 26 | 26 | 22 | 22 | 20 | 20 | 20 | 19 | 20 | 21 | 21 | 22 | 22 | 16 | 16 | 16 | 16 | 16 | 16 | 16 | 16 |
| 1000 | 30 | 32 | 32 | 32 | 30 | 30 | 28 | 27 | 23 | 23 | 22 | 26 | 26 | 26 | 22 | 22 | 20 | 20 | 20 | 19 | 20 | 21 | 21 | 22 | 22 | 16 | 16 | 16 | 16 | 16 | 16 | 16 | 16 |
| 1100 | 30 | 34 | 33 | 32 | 31 | 31 | 29 | 26 | 24 | 23 | 22 | 27 | 26 | 26 | 22 | 22 | 20 | 20 | 20 | 19 | 20 | 21 | 21 | 22 | 22 | 16 | 16 | 16 | 16 | 16 | 16 | 16 | 16 |
| 1200 | 30 | 36 | 34 | 32 | 31 | 32 | 30 | 24 | 25 | 24 | 24 | 23 | 22 | 22 | 22 | 22 | 20 | 20 | 20 | 19 | 20 | 21 | 21 | 22 | 22 | 16 | 16 | 16 | 16 | 16 | 16 | 16 | 16 |
| 1300 | 30 | 36 | 33 | 34 | 32 | 33 | 31 | 24 | 26 | 26 | 25 | 25 | 25 | 23 | 21 | 21 | 20 | 20 | 20 | 19 | 20 | 21 | 21 | 22 | 22 | 18 | 18 | 18 | 18 | 18 | 18 | 18 | 18 |
| 1400 | 31 | 36 | 31 | 36 | 33 | 31 | 30 | 24 | 26 | 27 | 28 | 28 | 28 | 28 | 21 | 21 | 20 | 20 | 20 | 19 | 20 | 21 | 21 | 22 | 22 | 18 | 18 | 18 | 18 | 18 | 18 | 18 | 18 |
| 1500 | 31 | 36 | 30 | 36 | 33 | 32 | 30 | 26 | 27 | 29 | 30 | 39 | 31 | 26 | 20 | 20 | 20 | 20 | 20 | 19 | 20 | 21 | 21 | 22 | 22 | 20 | 20 | 20 | 20 | 20 | 20 | 20 | 20 |
| 1600 | 32 | 36 | 31 | 36 | 34 | 33 | 31 | 27 | 28 | 29 | 30 | 32 | 32 | 27 | 22 | 22 | 22 | 22 | 22 | 19 | 20 | 21 | 21 | 22 | 22 | 22 | 22 | 22 | 22 | 22 | 22 | 22 | 22 |
| 1700 | 28 | 38 | 31 | 36 | 33 | 32 | 31 | 28 | 29 | 29 | 28 | 32 | 32 | 28 | 23 | 23 | 24 | 24 | 24 | 19 | 20 | 21 | 21 | 22 | 22 | 22 | 22 | 22 | 22 | 22 | 22 | 22 | 22 |
| 1800 | 24 | 38 | 32 | 38 | 33 | 32 | 32 | 29 | 30 | 29 | 29 | 28 | 27 | 26 | 25 | 25 | 26 | 26 | 26 | 19 | 20 | 21 | 21 | 22 | 22 | 22 | 22 | 22 | 22 | 22 | 22 | 22 | 22 |
| 1900 | 24 | 40 | 31 | 40 | 33 | 33 | 32 | 32 | 31 | 37 | 36 | 32 | 27 | 27 | 26 | 26 | 25 | 25 | 25 | 18 | 19 | 20 | 21 | 22 | 22 | 23 | 23 | 23 | 23 | 23 | 23 | 23 | 23 |
| 2000 | 24 | 30 | 30 | 36 | 33 | 33 | 33 | 32 | 32 | 34 | 36 | 32 | 27 | 27 | 27 | 27 | 24 | 24 | 24 | 18 | 19 | 20 | 21 | 22 | 22 | 24 | 24 | 24 | 24 | 24 | 24 | 24 | 24 |
| 2100 | 24 | 30 | 29 | 34 | 33 | 33 | 33 | 33 | 33 | 34 | 35 | 31 | 27 | 28 | 28 | 28 | 23 | 23 | 23 | 20 | 21 | 21 | 22 | 22 | 22 | 24 | 24 | 24 | 24 | 24 | 24 | 24 | 24 |
| 2200 | 30 | 30 | 29 | 32 | 33 | 33 | 34 | 34 | 34 | 35 | 35 | 31 | 27 | 29 | 30 | 30 | 24 | 24 | 24 | 23 | 23 | 23 | 23 | 23 | 23 | 24 | 24 | 24 | 24 | 24 | 24 | 24 | 24 |
| 2475 | 30 | 30 | 28 | 30 | 30 | 30 | 34 | 34 | 34 | 34 | 34 | 31 | 27 | 30 | 32 | 32 | 25 | 25 | 25 | 25 | 25 | 24 | 24 | 23 | 23 | 24 | 24 | 24 | 24 | 24 | 24 | 24 | 24 |
| 2750 | 30 | 30 | 29 | 33 | 33 | 33 | 34 | 34 | 34 | 36 | 37 | 35 | 33 | 32 | 31 | 31 | 26 | 26 | 26 | 27 | 26 | 25 | 24 | 23 | 23 | 25 | 25 | 25 | 25 | 25 | 25 | 25 | 25 |
| 3025 | 30 | 30 | 30 | 31 | 32 | 32 | 33 | 34 | 34 | 37 | 39 | 36 | 33 | 31 | 29 | 29 | 27 | 27 | 27 | 29 | 28 | 26 | 25 | 23 | 23 | 24 | 24 | 22 | 22 | 22 | 22 | 22 | 22 |
| 3300 | 46 | 46 | 37 | 37 | 38 | 38 | 40 | 41 | 35 | 36 | 36 | 35 | 33 | 31 | 28 | 28 | 31 | 31 | 31 | 31 | 30 | 29 | 28 | 27 | 27 | 24 | 24 | 22 | 22 | 22 | 22 | 22 | 22 |
| 3575 | 46 | 46 | 43 | 43 | 43 | 43 | 46 | 48 | 35 | 34 | 33 | 33 | 32 | 29 | 26 | 26 | 34 | 34 | 34 | 33 | 32 | 32 | 31 | 30 | 30 | 24 | 24 | 22 | 22 | 22 | 22 | 22 | 22 |
| 3850 | 46 | 46 | 50 | 49 | 49 | 48 | 50 | 52 | 35 | 34 | 32 | 31 | 30 | 29 | 28 | 28 | 33 | 33 | 33 | 34 | 32 | 31 | 29 | 27 | 27 | 24 | 24 | 22 | 22 | 22 | 22 | 22 | 22 |
| 4125 | 46 | 46 | 53 | 60 | 60 | 59 | 57 | 56 | 35 | 33 | 30 | 30 | 29 | 30 | 30 | 30 | 32 | 32 | 32 | 35 | 32 | 30 | 27 | 24 | 24 | 24 | 24 | 22 | 22 | 22 | 22 | 22 | 22 |
| 4400 | 46 | 46 | 50 | 60 | 49 | 48 | 32 | 34 | 35 | 34 | 32 | 30 | 27 | 28 | 29 | 29 | 32 | 32 | 32 | 33 | 31 | 28 | 26 | 23 | 23 | 23 | 23 | 22 | 22 | 22 | 22 | 22 | 22 |
| 4675 | 46 | 46 | 50 | 60 | 49 | 48 | 32 | 34 | 35 | 34 | 33 | 31 | 28 | 28 | 29 | 29 | 32 | 32 | 32 | 31 | 29 | 27 | 24 | 23 | 23 | 22 | 22 | 22 | 22 | 22 | 22 | 22 | 22 |
| 4950 | 46 | 46 | 50 | 60 | 49 | 48 | 32 | 34 | 35 | 35 | 36 | 32 | 29 | 29 | 29 | 29 | 32 | 32 | 32 | 32 | 30 | 27 | 25 | 22 | 22 | 22 | 22 | 24 | 24 | 24 | 24 | 24 | 24 |
| 5225 | 46 | 46 | 50 | 60 | 49 | 48 | 32 | 34 | 35 | 36 | 36 | 32 | 29 | 29 | 29 | 29 | 32 | 32 | 32 | 29 | 27 | 26 | 24 | 22 | 22 | 22 | 22 | 24 | 24 | 24 | 24 | 24 | 24 |
| 5500 | 46 | 46 | 50 | 60 | 39 | 31 | 32 | 34 | 35 | 36 | 36 | 32 | 29 | 29 | 29 | 29 | 32 | 32 | 32 | 29 | 27 | 26 | 24 | 22 | 22 | 22 | 22 | 24 | 24 | 24 | 24 | 24 | 24 |
| 5775 | 46 | 46 | 50 | 60 | 29 | 31 | 32 | 34 | 35 | 36 | 36 | 32 | 29 | 29 | 29 | 29 | 32 | 32 | 32 | 29 | 27 | 26 | 24 | 22 | 22 | 22 | 22 | 24 | 24 | 24 | 24 | 24 | 24 |
| 6050 | 46 | 46 | 46 | 60 | 29 | 31 | 32 | 34 | 35 | 36 | 36 | 32 | 29 | 29 | 29 | 29 | 32 | 32 | 32 | 29 | 27 | 26 | 24 | 22 | 22 | 22 | 22 | 24 | 24 | 24 | 24 | 24 | 24 |

940

FIG. 11

| DEMAND (%) | 0.0 | 6.2 | 12.5 | 18.7 | 25.0 | 31.2 | 37.5 | 43.7 | 50.0 | 59.3 | 65.6 | 71.8 | 78.1 | 84.4 | 90.6 | 96.8 | 100.0 |
|---|---|---|---|---|---|---|---|---|---|---|---|---|---|---|---|---|---|
| TORQUE (FOOT-POUNDS) | 0.00 | 17.50 | 35.00 | 52.50 | 70.00 | 87.50 | 105.00 | 122.50 | 140.00 | 157.50 | 175.00 | 192.50 | 210.00 | 227.50 | 245.00 | 262.50 | 280.00 |

FIG. 12

ENGINE CONTROL SYSTEM USING AN AIR AND FUEL CONTROL STRATEGY BASED ON TORQUE DEMAND

BACKGROUND OF THE INVENTION

1. Field of the Invention

The present invention is generally related to an engine control system and, more particularly, to an engine control system that uses a manually controlled torque demand signal to determine the appropriate engine control strategies relating to air supply, fuel supply, and ignition control.

2. Description of the Prior Art

Most known engine control systems rely on a manually controlled throttle position setting that determines the rate of air supply to the engine. Other variables, such as fuel supply and ignition timing, are dependent on the manually controlled rate of air supply to the engine. These parameters are typically stored as a function of load and engine speed.

U.S. Pat. No. Re34,803, which issued to Chasteen on Dec. 6, 1994, describes a two-cycle engine with an electronic fuel injection system. The fuel injection controlling device comprises an air manifold, a throttle valve, a fuel injector, a fuel supply system including a fuel pump, a battery voltage sensor, an air temperature sensor, an engine speed sensor, a timing sensor, a barometric pressure sensor, a throttle position sensor, a first data processor for receiving and processing sensing signals for determining fuel injector duration and timing the fuel pump operating speed, a first data processor temperature sensor for sensing the relative temperature of certain electronic components in the first data processor, a heater operatively associated with the first data processor electronic components for selectively heating the electronic components, and a second data processor operable independently of the first data processor for receiving an electronic component temperature sensing signal and for generating a control signal to the heater responsive thereto for heating the components when the temperature thereof is below a predetermined minimum value.

U.S. Pat. No. 5,749,344, which issued to Yoshiume et al on May 12, 1998, describes a fuel supply control system for an internal combustion engine. A throttle valve opening and an engine rotational speed are detected to estimate intake air pressure of an engine. Fuel consumption is estimated from the estimated intake air pressure. The fuel pump drive voltage is calculated from estimated intake air pressure and estimated fuel consumption through a data map. This map is set in advance from data measured experimentally. By thus driving the fuel pump, it can be controlled at an earlier relative time by taking the response time delay of the control system and the fuel pump into consideration.

U.S. Pat. No. 5,626,120, which issued to Akatsuka on May 6, 1997, describes an engine control system and method. A control system and method for an internal combustion engine that employs a throttle position sensor and an engine speed sensor is described. The initial fuel air ratio control is based upon a map experimentally determined from throttle position and engine speed settings for optimum performance. However, in the event the throttle position sensor is deemed to be inaccurate, then another method is utilized for engine control purposes. In most embodiments, a map is also used in the other way.

U.S. Pat. No. 5,813,374, which issued to Chasteen on Sep. 29, 1998, describes a two cycle engine with an electronic fuel injection system. A fuel injection system for a two stroke engine comprises an air manifold, a throttle valve, a fuel injector, a fuel supply system including a fuel pump, a battery voltage sensor, an air temperature sensor, an engine speed sensor, a timing sensor, a barometric pressure sensor, a throttle position sensor, a first data processor for receiving and processing sensing signals for determining fuel injector duration and timing and fuel pump operating speed, a first data processor temperature sensor for sensing the relative temperature of certain electronic components in the first data processor, a heater operatively associated with the first data processor electronic components for selectively heating the electronic components, and a second data processor operable independently of the first data processor for receiving an electronic component temperature sensing signal and for generating a control signal to the heater responsive thereto for heating the components when the temperature thereof is below a predetermined minimum value.

U.S. Pat. No. 4,779,581, which issued to Maier on Oct. 25, 1988, describes a dual fuel injection system for two stroke internal combustion engines. The engine comprises a cylinder, a crankcase extending from the cylinder, a piston reciprocal in the cylinder and defining, with the cylinder, a variable volume combustion chamber and defining, with the crankcase, a crankcase chamber having a volume which varies inversely with respect to the volume of the combustion chamber, a transfer passage communicating, subject to piston movement, between the crankcase chamber and the combustion chamber, an air intake passage extending from the crankcase chamber and including therein a throttle valve movable between opened and closed positions to control engine speed, a reed valve located between the air intake passage and the crankcase chamber for controlling communication between the air intake passage and the crankcase chamber, a first fuel injector communicating with the transfer passage, a second fuel injector communicating with the air intake passage between the reed valve and the throttle valve, and a controller for actuating the first fuel injector to supply fuel to the transfer passage at relatively low engine speeds and for actuating the second fuel injector to supply fuel to the intake passage at relatively high engine speeds.

U.S. Pat. No. 5,848,582, which issued to Ehlers et al on Dec. 15, 1998, discloses an internal combustion engine with barometric pressure related start of air compensation for a fuel injector. The control system for a fuel injector system for an internal combustion engine is provided with a method by which the magnitude of the start of air point for the injector system is modified according to the barometric pressure measured in a region surrounding the engine. This offset, or modification, of the start of air point adjusts the timing of the fuel injector system to suit different altitudes at which the engine may be operating.

The United States patents described above are hereby expressly incorporated by reference in the description of the present invention.

In marine propulsion and control systems that utilize electronic throttle control systems, no cable connection is provided between the throttle handle, which is controlled by an operator of the marine vessel, and the internal combustion engine that provides the propulsive force for the vessel. It would therefore be significantly beneficial if an engine control system could be provided which specifically selects the rates of supply of both fuel and air to the cylinders of the engine and, in addition, determines the ignition timing and energy parameters for the engine.

SUMMARY OF THE INVENTION

In one preferred embodiment, the present invention provides a method for controlling the operation of the engine which comprises the steps of measuring an operating speed of the engine; sensing a manually controlled command signal; determining, as a function of the operating speed and the command signal, a quantity of fuel to be supplied to a cylinder of the engine for each cycle of the engine; determining, as a function of the operating speed and the command signal, a desired quantity of air to be supplied to the cylinder of the engine for each cycle of the cylinder; and determining, as a function of the operating speed and the command signal, the timing of an activation of a spark plug of the engine for each cycle of the cylinder, the spark plug being associated with the cylinder.

The method of the present invention can further comprise the steps of measuring the barometric pressure in the vicinity of the engine and modifying the manually controlled command signal as a function of the barometric pressure. It can further comprise the steps of calculating an actual magnitude of the quantity of air supplied to the cylinder of the engine and comparing the actual magnitude of the quantity of air to the desired quantity of air.

The present invention can further comprise the steps of measuring a temperature of the air proximate the engine, and calculating the actual magnitude of air as a partial function of the temperature. The method can further comprise the step of determining, as a function of the operating speed and the command signal, a volumetric efficiency of air being supplied to the cylinder and then modifying the actual magnitude of the quantity of air as a function of the volumetric efficiency. The present invention can further comprise the step of determining an error magnitude between the actual magnitude of the quantity of air and the desired quantity of air and then modifying the manually controlled command signal as a function of the error magnitude of air. In addition, the present invention can further comprise the steps of measuring a throttle position and modifying the command signal when the command signal is generally equal to its maximum value while the throttle position is not generally equal to its maximum open position.

BRIEF DESCRIPTION OF THE DRAWINGS

The present invention will be more fully and completely understood from a reading of the description of the preferred embodiment in conjunction with the drawings, in which:

FIGS. 11 and 12 show two actual matrices used in certain prototype embodiments of the present invention.

DESCRIPTION OF THE PREFERRED EMBODIMENT

Figure 1:
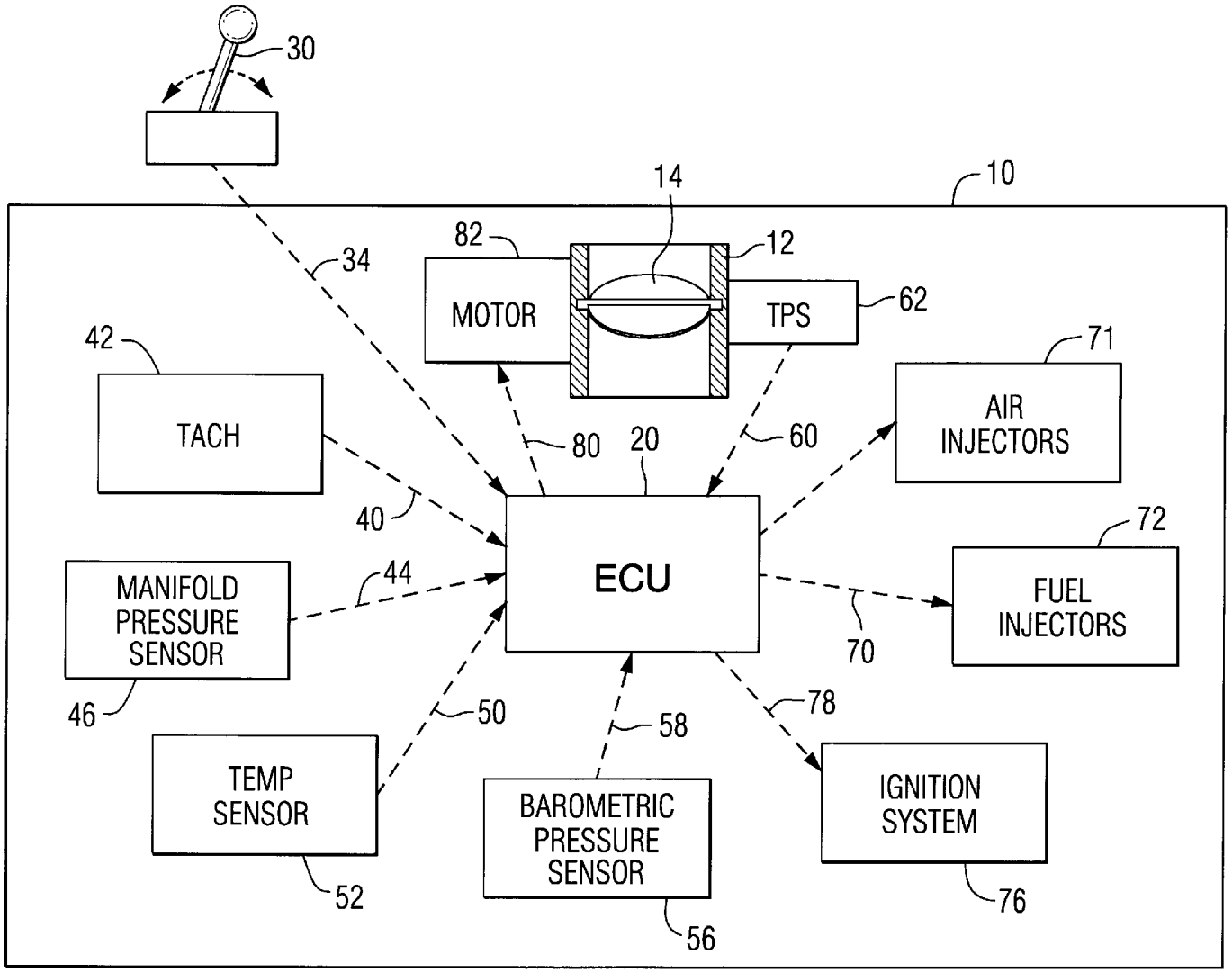
FIG. 1 is a schematic representation of an engine with its associated sensors and control components.

Throughout the description of the preferred embodiment, like components will be identified by like reference numerals.

FIG. 1 is a highly simplified schematic representation of the present invention associated with a marine propulsion system. Associated with the overall structure of an engine 10, is a throttle body structure 12 through which air passes as it enters the engine 10. A throttle plate 14 is rotatably supported within the throttle body structure 12. An engine control unit (ECU) 20 is connected in signal communication with several sensors in order to enable the ECU 20 to properly select the magnitudes of fuel and air that are provided to each cylinder of the engine 10.

With continued reference to FIG. 1, one of the sensor signals provided to the ECU 20 represents the physical position of a throttle handle 30. The throttle handle 30 is manually moveable and a signal is provided to the ECU 20 on line 34 which represents the position of the throttle handle 30 which, in turn, represents a demand for torque. The ECU 20 is provided with a signal on line 40 representing engine speed. The signal can be provided by a tachometer 42 or any other instrument that is capable of providing a signal to the ECU 20 representing engine speed. On line 44, the engine control unit is provided with a signal that is representative of manifold pressure. Any type of manifold pressure sensor 46 that is capable of providing information to the ECU 20 that is representative of manifold absolute pressure can be used for these purposes.

On line 50, the ECU 20 is providing with information representing the temperature at one or more selective locations on the engine 10. Various types of temperature sensors 52 are suitable for these purposes. The engine control unit 20 is also provided with information, from a barometric pressure sensor 56, on line 58.

With continued reference to FIG. 1, the engine control unit 20 is also provided with information that represents the actual angular position of the throttle plate 14. This information is provided on line 60 by a throttle position sensor 62, or TPS.

The engine control unit 20 provides certain output signals that allows it to control the operation of certain components relating to the engine. For example, the engine control unit 20 provides signals on line 70 to the fuel injectors 72 which determines the amounts of fuel and air provided on each cycle of the air injectors 71 and fuel injectors 72. The ECU 20 also controls the ignition system 76 by determining the timing and spark energy of each ignition event. The output signals provided by the ECU 20 for these purposes are provided on line 78. FIG. 1 shows the schematic representation of the various sensors and components that are used by the engine control unit 20 to control the operation of the engine 10 in direct response to the position of a throttle handle 30. It should be understood that the position of the throttle handle 30 is, in actuality, a request by the operator of a marine vessel for a relative amount of torque to be provided to the propeller shaft of the propulsion system. The position of the throttle handle 30 can be moved by the operator of the marine vessel at any time during the operation of the marine vessel. For example, if the marine vessel is traveling at a generally constant speed, the operator of the marine vessel can move the throttle handle 30 in one direction to increase the speed by providing increased torque to the propeller shaft or, alternatively, the operator of the marine vessel can move the throttle handle 30 in the opposite direction to decrease the amount of torque provided to the propeller shaft and, as a result, decrease the speed of the marine vessel. It should be noted that no direct physical connection is provided between the throttle handle 30 and the throttle plate 14. The operator does not directly cause the throttle plate 14 to change position in a marine propulsion system made in accordance with the present invention. Instead, the engine control unit 20 receives the signals on line 34 that represent the position of the throttle handle 30 and, as will be described in greater detail below, combines that information with other information relating to the operation of the engine 10, by providing appropriate signals on line 80. It then causes a motor 82 to rotate the throttle plate 14 to a desired position to achieve the torque command received on line 34 from the throttle handle 30.

Figure 2:
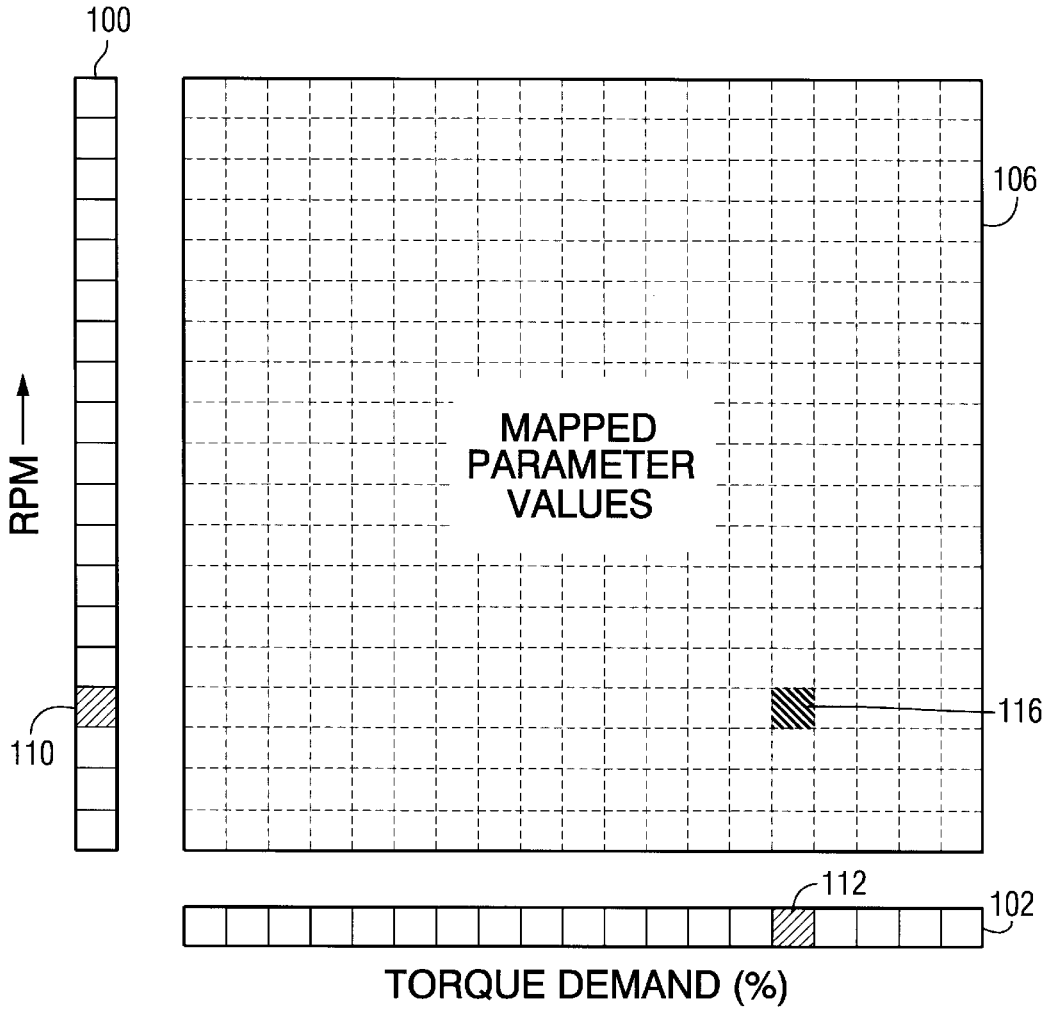
FIG. 2 is a hypothetical representation of a parameter map matrix.

FIG. 2 shows the basic structure of a map of a parameter value. The map shown in FIG. 2 does not contain any values and is intended to describe a basic concept used to implement the present invention. The mapped parameter values stored in a micro-processor can be a fuel per cycle (FPC), an air/fuel ratio, or any other numeric parameter required by the present invention. Most of the mapped parameter values used by the present invention are stored as a function of two measured variables, engine speed measured in RPM and torque demand measured as a percentage of maximum torque demand. The actual current engine speed is received by the engine control unit 20 on line 40 from a tachometer 42 or other sensor that is capable of providing a measured engine speed value. Torque demand is a value that represents the position of the throttle handle 30 stored as a percentage, of its maximum position. Both of the independent variables, engine speed and torque demand, are provided with an ordinate array, 100 and 102 respectively. The ordinate arrays are one dimensional arrays that contain values that allow the micro-processor to select the appropriate row or column of the map based on the independent variables measured by the sensors and provided to the ECU 20. For example, the ordinate array 100 associated with engine speed will contain magnitudes of RPM that represent the associated rows in the map 106. Similarly, the one dimensional array 102 would contain various percentages that assist the micro-processor in selecting a column of the map 106. For example, if the engine speed is determined to match the category represented by entry 110 of ordinate array 100 and the torque demand is determined to be represented by the range contained in entry 112 of ordinate array 102, these two values are used to select the row and column, respectively, in the map. In the example used in conjunction with FIG. 2, this would result in the selection of the value contained at location 116 of map 106. Continuing with this example, if the map 106 represented a fuel per cycle (FPC) value, the value would be selected from location 116 and used for the intended purposes. It should be understood that the arrangement represented in FIG. 2 is used by the present invention to select many different variables as a function of engine speed and torque demand. It should also be understood that the specific dimensions of the map 106 are not limiting to the present invention. For example, certain map matrices are 33 by 33 in dimension while others are 9 by 9 in dimension. Similarly, it is not a requirement of the present invention that the matrices be equal in its both dimensions. For example, certain data magnitudes may be more appropriately stored in a 33 by 10 matrix while others are able to be stored in 9 by 9 matrices. The size and dimensions of each data map 106 are determined as a function of the required resolution needed to appropriately select the rows and columns of the map. For purposes of the following description, the representative matrices will be provided with a darkened entry, such as that identified by reference numeral 116 in FIG. 2, to represent the fact that only a single numeric variable is used from any particular map during any particular calculation.

Throughout the description of the preferred embodiment of the present invention, the various parameter maps are described in terms of engine speed and torque demand, which is identified as "DEMAND" in the figures. However, it should be understood that a preferred embodiment of the present invention initially converts the actual position of the throttle handle 30 to a value that is normalized as a function of the ratio of the measured barometric pressure divided by a reference barometric pressure used to empirically determine the data within the various parameter maps. Therefore, the term "DEMAND" actually represents an adjusted "DEMAND (BARO)" determined by multiplying the actual measured demand position of the throttle handle 30 and multiplying it by the ratio of the measured barometric pressure to a reference barometric pressure.

Figure 3:
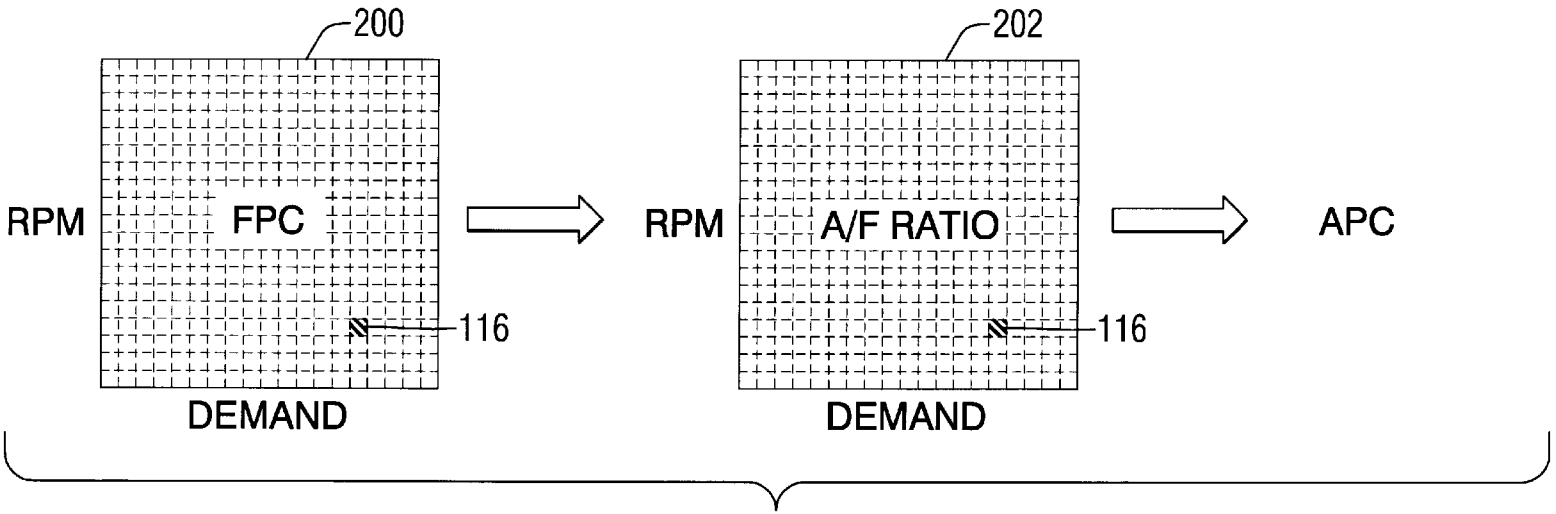
FIG. 3 shows two matrices used to calculate air per cycle as a function of fuel per cycle and the air/fuel ratio.
Figure 9:
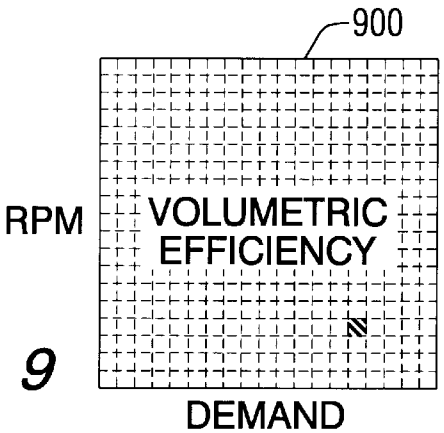
FIG. 9 shows a map containing volumetric efficiencies.

FIG. 3 represents the steps that the present invention takes to determine the appropriate air per cycle (APC) for each cycle of the engine 10. Using a fuel per cycle map 200, the appropriate fuel per cycle magnitude stored at location 116, is determined as a function of the engine speed and torque demand which are identified simply as "RPM" and "DEMAND" in the figures. After the fuel per cycle (FPC) is determined as a function of the engine speed and torque demand, the engine control unit (ECU) then uses an associated A/F RATIO map to select the air/fuel ratio appropriate for the measured engine speed and torque demand. Again, that relative position in the A/F RATIO map is identified by reference numeral 116 although the A/F RATIO map 202 is independent of the fuel per cycle ratio map 200. Once the ECU 20 has determined the fuel per cycle and air/fuel ratio, the air per cycle (APC) can be calculated.

With continued reference to FIG. 3, it should be understood that the fuel per cycle (FPC) can be represented in map 200 as the numeric value in milligrams per cylinder per cycle and the air per cycle (APC) can be calculated as milligrams per cylinder per cycle.

Figure 4:
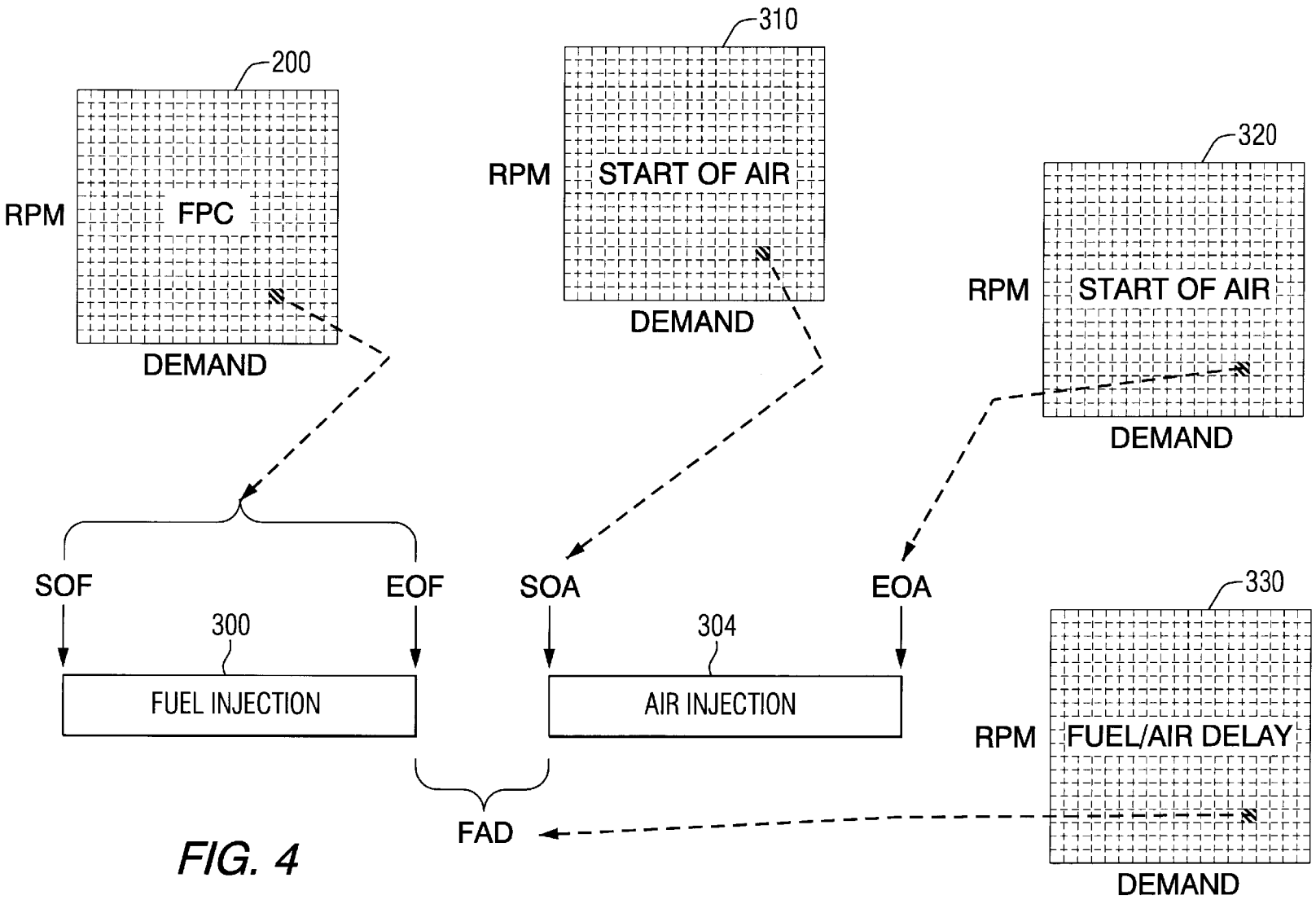
FIG. 4 is a schematic representation of four parameter maps used to determine the fuel injection and air injection timing for the engine.

FIG. 4 is a schematic representation of the way that the present invention determines the necessary variables to control the fuel injection process. In U.S. Pat. No. 5,848,582, which is described above, the fuel injection event 300 and air injection event 304 are described in explicit detail.

Using the information obtained from the fuel per cycle map 200, the length of the fuel injection event 300 can be determined. Using a start of air map 310, the present invention can select the start of air timing, measured in degrees before top dead center (BTDC) as a function of engine speed and torque demand. This start of air (SOA) information fixes the beginning of the air injection event 304 as a function of the position of the crankshaft of the engine 10. Using map 320, the present invention selects the end of air (EOA), measured in degrees before top dead center (BTDC), as a function of engine speed and torque demand. The information obtained from the start of air map 310 and the end of air map 320 allows the present invention to precisely set the length and timing of the air injection event 304 as a function of the angular position of the crankshaft.

With continued reference to FIG. 4, the present invention uses a fuel/air delay map 330 to select the fuel/air delay (FAD) that is defined as the time between the start of air (SOA) and the end of fuel (EOF). This allows the present invention to accurately determine the end of fuel (EOF), measured in degrees before top dead center (BTDC). Once the end of fuel (EOF) timing is determined in this way, the fuel per cycle information obtained from map 200 can be used to determine the start of fuel (SOF) timing. As can be seen in FIG. 4, the four maps shown in the figure allow the present invention to specifically set the beginnings and endings of both the fuel injection event 300 and the air injection event 304 as a direct function of the engine speed and torque demand.

Figure 5:
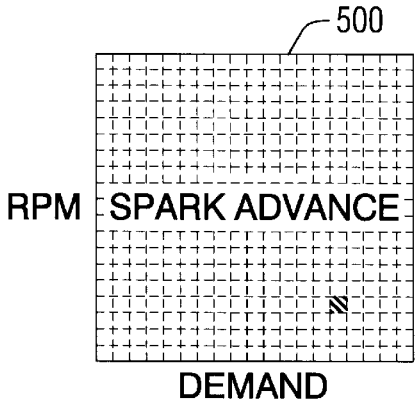
FIGS. 5 and 6 show the parameter maps for spark advance and spark energy.

With reference to FIG. 5, the spark advance can be selected from a spark advance map 500. This information can typically be measured in degrees before top dead center (BTDC) and is used to determine the time at which a spark plug should be energized.

Figure 6:
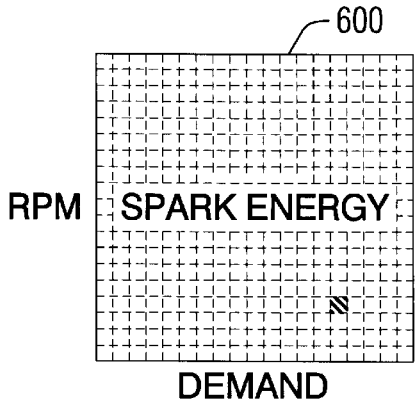

FIG. 6 illustrates a spark energy map 600 that contains information, measured in millijoules which defines the spark energy that should be provided to the spark plug as a function of engine speed and torque demand. The spark energy map 600 is typically a 9 by 9 matrix because a high degree of resolution is not usually necessary.

Figure 7:
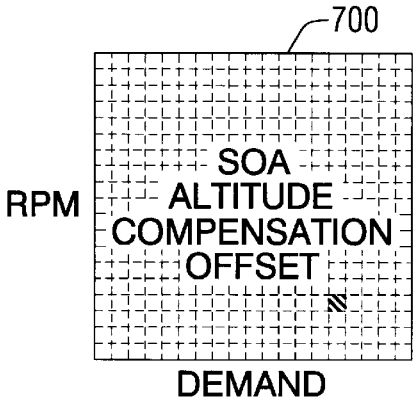
FIGS. 7 and 8 show the altitude compensation offset and TPS adaptive correction maps.

With reference to the start of air (SOA) MAP 310 in FIG. 4 and the altitude compensation offset map 700 in FIG. 7, it should be understood that the present invention is capable of making a correction to the start of air timing as a function of the altitude at which the engine is operated. With reference to FIGS. 4 and 7, the present invention can determine an altitude compensation offset from map 700 as a function of engine speed and torque demand. This offset value, which is then multiplied by the actual barometric pressure, can be used to provide a correction for the information obtained from map 310.

The various parameters described above can be selected by the present invention, as a function of engine speed and torque demand, and used to control the operation of the engine. It is helpful if the control system can actually monitor the operation of the engine to make sure that the desired result is actually occurring. For example, the air per cycle value is calculated and the motor 82 is used to adjust the position of the throttle plate 14 to allow sufficient air to flow into the engine 10. However, the present invention further calculates the actual amount of air flowing into the cylinder to compare that value to the desired value.

Using the ideal gas equation shown below as equation 1, the mass of air flowing into each cylinder during each cycle can be calculated as a function of known or measured variables.

$$PV=mRT \tag{1}$$

In equation 1 shown above, the pressure P is the manifold absolute pressure and can be measured by sensor 46 and provided by information to the ECU 20 on line 44. The volume V is known for each cylinder during a complete sweep of its related piston. The ideal gas constant R is a known magnitude and the temperature T of the air flowing into the engine can be measured by a temperature sensor 52 and provided on line 50 to the engine control unit 20.

Equation 1 can be rearranged and provided with a variable ($\eta_v$) which represents the volumetric efficiency of the process. The volumetric efficiency for air passing into a cylinder of an engine can be empirically derived.

$$m=((PV)/(RT))(\eta_v) \tag{2}$$

The volumetric efficiency ($\eta_v$) is obtained by the present invention from a volumetric efficiency map 900. For each engine speed and torque demand value, a volumetric efficiency value is stored in the map 900. All of the variables in equation 2, except for the mass of air (m) are known, either by direct measurement (P and T), information relating to a constant value (V and R), or an empirically derived magnitude ($\eta_v$). This allows the present invention to determine the actual mass of air flowing into the cylinder for each cycle.

Figure 10:
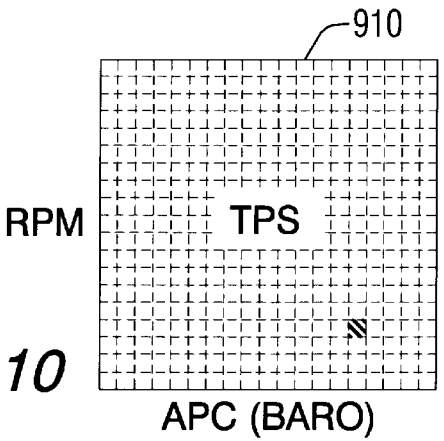
FIG. 10 shows a throttle position map.

In the description of the air per cycle (APC) determination described above in conjunction with FIG. 3, it was mentioned that the throttle plate 14 is set by the motor 82 based on a command received on line 80 from the engine control unit 20. This throttle position of the throttle plate 14 is initially determined empirically for each engine and stored in a throttle position map 910 as shown in FIG. 10. The data stored in map 910 defines the desired position of the throttle plate 14, as measured by the throttle position sensor 62, for each combination of engine speed is and calculated APC. It should be understood that the magnitude stored in map 910 are intended for use as initial positions and it is expected that, as will be described below, additional information obtained by the engine control unit 20 will cause the engine control unit to make subsequent adjustments to the physical position of the throttle plate 14. In other words, the information contained in map 910 shown in FIG. 10 provides a generally accurate position for the throttle plate 14, but it is expected that additional information will result in changes to the position of the throttle plate 14 to a slightly different position than that stored in map 910. It should also be noted, unlike many other maps described above, the throttle position map 910 selects the throttle position based on engine speed and the air per cycle (APC) magnitude, corrected for barometric pressure, that had been obtained from the calculation described above in conjunction with FIG. 3. The calculated air per cycle (APC) is multiplied by the ratio of the barometric pressure used in the empirical determination of the values in map 910 and divided by the actual measured current barometric pressure. After multiplying the calculated APC by this barometric correction ratio, the resulting magnitude is used, in combination with engine speed, to select the throttle position from map 910.

As described above, the present invention calculates the actual mass of air provided to each cylinder during each cycle based on equation 2 above. The result of that calculation can be compared to the air per cycle (APC) value calculated in the manner described above in conjunction with FIG. 3. If these two magnitudes are not equal to each other, within an acceptable tolerance band, the ECU 20 can command the motor 82 to move the actual position of the throttle plate 14. Using a PID algorithm, the throttle plate 14 can be continuous adjusted, in an incremental manner determined by the magnitude of the error in APC, until this error is driven to zero.

Figure 8:
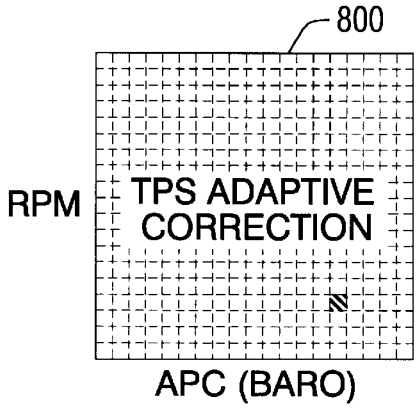

Certain embodiments of the present invention can implement a throttle position adaptive correction map 800 as shown in FIG. 8. This map 800 would be used in circumstances when the throttle handle 30 is not at its maximum position and the air per cycle (APC) controller is active. The matrix shown in FIG. 8 would contain percentage values for each position in the map 800. The values selected from the TPS adaptive correction map 800 are selected as a function of the engine speed and the APC value calculated as described above in conjunction with FIG. 3 and as corrected in the manner described in conjunction with FIG. 10.

Under certain conditions, the present invention can execute all of the steps described above in conjunction with FIGS. 1–10 and, following all of those selections and calculations, a situation may exist wherein the throttle handle 30 is at its maximum position, demanding maximum torque, while the throttle plate 14 is not at its maximum position to allow maximum air to flow into the engine 10. This situation is an anomaly because any position of the throttle plate 14 other than its maximum air flow position is suboptimal. To correct this potentially suboptimal situation, the present invention creates a multiplier which is used in situations when the throttle handle 30 is at its maximum torque demand position. The multiplier is stored by a microprocessor and adjusted by the present invention to make sure that when maximum torque is requested by the throttle handle 30, a maximum air flow position for the throttle plate 14 occurs. This multiplier is used to multiply the measured torque demand on line 34, from the throttle handle 30. The adjusted torque demand, which has multiplied by this multiplier, is then used to select new information from all of the parameter matrices described above. As an example, if the ECU 20 receives a signal of 100% from the throttle handle 30 and the resulting selections from the matrices, in combination with the calculations described above, do not result in a maximum airflow position of the throttle plate 14, the value of 100% for throttle handle position is adjusted upward incrementally. For example, this value may be initially altered to 101% and stored as the multiplier for these purposes. The present invention will perform the steps described above in selecting data from the various matrices and performing the calculations to determine all of the parameters for control of the engine 10. Then, if the throttle handle 300 was still in its maximum position, the ECU 20 would again interrogate the throttle position sensor (TPS) 62 to see if the throttle plate 14 was in its maximum air flow position. If not, the multiplier would be again incremented to 102%, notwithstanding the actual position of the throttle handle 30, and the calculations would be reiterated using the adjusted torque demand which had been artificially increased by the multiplier. These steps would continue to be reiterated until the throttle plate 14 was at its actual maximum airflow position. This process will result in an actual delivery of maximum available torque, with optimal airflow and optimal fuel per cycle provided to each cylinder.

FIG. 11 shows a map 940 with actual empirically derived data stored in each position of the matrix. Also shown in FIG. 11 are the ordinate arrays for both engine speed and torque demand. In the ordinate array 942, the actual engine speeds for each row in the matrix 940 are stored. This allows the microprocessor to compare a measured engine speed with these various entries in ordinate array 942 to select the appropriate row of the matrix 940. Similarly, ordinate array 944 contains various torque demand percentages between 0 and 100. Following a determination of engine speed and torque demand, the microprocessor selects the row and column suitable for the current operating condition of the engine. For example, if the matrix 940 in FIG. 11 represents the spark advance map for an engine, measured in degrees before top dead center (BTDC), and the engine speed was 4670 RPM in combination with a torque demand of 68%, the present invention would select the value "24" from matrix 940. As a result, the spark advance would be determined to be 24 degrees before top dead center (BTDC). FIG. 12 shows a one dimensional array that shows the actual torque, measured in foot-pounds, in comparison to the torque demand as a percentage of maximum demand. The values in FIG. 12 allow the actual torque to be determined as a function of the value obtained by the ECU 20 on line 34 from the throttle handle 30.

The present invention utilizes an engine control unit 20 to measure a desired torque, represented by the torque demand position of a throttle handle 30, and determines all necessary settings for the parameters used to control the operation of an engine 10 in order to conform to the manually determined torque demand, adjusted for barometric pressure. The engine control unit 20 measures engine speed with a tachometer 42, measures pressure with a manifold pressure sensor 46 and a barometric pressure sensor 56, measures temperature with a temperature sensor 52, and measures the position of a throttle plate 14 with a throttle position sensor 62. With this information provided by various sensors and the throttle handle 30, the engine control unit 20 controls the timing of fuel injectors 72 and the ignition system 76 of the engine and also manipulates the position of the throttle plate 14 with a motor 42. Based on the torque demand, provided by the throttle handle 30, the engine control unit 20 determines the fuel per cycle (FPC) from map 200 and the required air/fuel ratio from map 202. This allows the present invention to calculate the air per cycle (APC) as described above in conjunction with FIG. 3. To control the spark of the engine, the spark advance is determined, in degrees before top dead center (BTDC) from map 500 and the spark energy, measured in millijoules, from map 600, as described above in conjunction with FIGS. 5 and 6. The specific timing of the fuel injection event 300 and air injection event 304 is specifically set in accordance with information obtained from maps 200, 310, 320, and 330, as described in conjunction with FIG. 4. The actual mass of air flowing into each cylinder during each cycle is calculated in accordance with equations 1 and 2, as described above. An initial throttle position is set based on information obtained from a map 910 which stores approximate throttle positions as a function of engine speed and air per cycle, as corrected for barometric pressure. The air per cycle that is measured and calculated in conjunction with equation 2 is compared to the desired air per cycle calculated as described in conjunction with FIG. 3 and a PID controller is used to correct for errors between these two values. The present invention also provides a throttle position adaptive correction map 800 which stores various percentage correction values as a function of engine speed and the air per cycle value, corrected for barometric pressure. The present invention also provides a corrective method to artificially change the received torque demand parameter in cases when the throttle handle 30 is in its maximum position, but the throttle plate 14 is not. The method of the present invention is iterative and continually monitors the various inputs and continuously changes the various outputs to assure that the torque demand is satisfied in the most efficient and effective manner possible.

The present invention has been described in detail with regard to the control of an engine which is provided with a direct fuel injection (DFI) system. This is a particularly preferred embodiment of the present invention that has been implemented. However, the present invention can also be used on a fuel injection system which is not a direct fuel injection system. This type of fuel injection system is commonly referred to as an electronic fuel injection (EFI) system and the fuel is injected into the airflow stream flowing from an intake manifold to the cylinders rather than directly into the cylinder as in a DFI system. If an EFI system is used in conjunction with the present invention, the various maps shown in FIG. 4 are not all necessary. Instead, an end of fuel (EOF) map can suffice.

The present invention has been described with particular specificity and illustrated to show one particularly preferred embodiment of the invention. However, it should be understood that alternative embodiments are also within its scope.

I claim:

1. A method for controlling the operation of an engine, comprising:

measuring an operating speed of said engine;

sensing a manually controlled command signal, said manually controlled command signal representing a magnitude of torque;

determining, as a function of said operating speed and said magnitude of torque, a quantity of fuel to be supplied to a cylinder of said engine for each cycle of said cylinder;

determining, as a function of said operating speed and said magnitude of torque, a desired quantity of air to be supplied to said cylinder of said engine for each cycle of said cylinder;

determining, as a function of said operating speed and said magnitude of torque, a timing of an activation of a sparkplug of said engine for each cycle of said cylinder, said sparkplug being associated with said cylinder;

calculating an actual magnitude of said quantity of air supplied to said cylinder of said engine;

comparing said actual magnitude of said quantity of air to said desired quantity of air;

determining an error magnitude of air between said actual magnitude of said quantity of air and said desired quantity of air; and modifying said manually controlled command signal as a function of said error magnitude of air.

2. The method of claim 1, further comprising:

measuring the barometric pressure in the vicinity of said engine.

3. The method of claim 2, further comprising:

modifying said manually controlled command signal as a function of said barometric pressure.

4. The method of claim 1, further comprising:

measuring a temperature of air proximate said engine.

5. The method of claim 4, wherein:

said actual magnitude of air is calculated as a partial function of said temperature.

6. The method of claim 1, further comprising:

determining, as a function of said operating speed and said command signal, a volumetric efficiency of air being supplied to said cylinder.

7. The method of claim 6, further comprising:

modifying said actual magnitude of said quantity of air as a function of said volumetric efficiency.

8. The method of claim 1, further comprising:

measuring a throttle position; and modifying said command signal when said command signal is generally equal to its maximum value and said throttle position is not generally equal to its maximum opened position.

9. A method for controlling the operation of an engine, comprising:

measuring an operating speed of said engine;

sensing a manually controlled command signal, said manually controlled command signal representing a magnitude of torque;

determining, as a function of said operating speed and said magnitude of torque, a quantity of fuel to be supplied to a cylinder of said engine for each cycle of said cylinder;

determining, as a function of said operating speed and said magnitude of torque, a desired quantity of air to be supplied to said cylinder of said engine for each cycle of said cylinder;

determining, as a function of said operating speed and said magnitude of torque, a timing of an activation of a sparkplug of said engine for each cycle of said cylinder, said sparkplug being associated with said cylinder;

measuring the barometric pressure in the vicinity of said engine;

modifying said magnitude of torque as a function of said barometric pressure;

measuring a throttle position; and modifying said command signal when said command signal is generally equal to its maximum value and said throttle position is not generally equal to its maximum opened position.

10. The method of claim 9, further comprising:

measuring a temperature of air proximate said engine calculating an actual magnitude of said quantity of air supplied to said cylinder of said engine as a partial function of said temperature of air proximate said engine; and comparing said actual magnitude of said quantity of air to said desired quantity of air.

11. The method of claim 10, further comprising:

determining, as a function of said operating speed and said command signal, a volumetric efficiency of air being supplied to said cylinder; and modifying said actual magnitude of said quantity of air as a function of said volumetric efficiency.

12. The method of claim 11, further comprising:

determining an error magnitude of air between said actual magnitude of said quantity of air and said desired quantity of air; and modifying said manually controlled command signal as a function of said error magnitude of air.

13. A system for controlling the operation of an engine, comprising:

means for measuring an operating speed of said engine;

means for sensing a manually controlled command signal, said manually controlled command signal representing a magnitude of torque;

means for determining, as a function of said operating speed and said magnitude of torque, a quantity of fuel to be supplied to a cylinder of said engine for each cycle of said cylinder;

means for determining, as a function of said operating speed and said magnitude of torque, a desired quantity of air to be supplied to said cylinder of said engine for each cycle of said cylinder;

means for determining, as a function of said operating speed and said magnitude of torque, a timing of an activation of a sparkplug of said engine for each cycle of said cylinder, said sparkplug being associated with said cylinder;

means for measuring the barometric pressure in the vicinity of said engine;

means for modifying said magnitude of torque as a function of said barometric pressure;

means for measuring a temperature of air proximate said engine means for calculating an actual magnitude of said quantity of air supplied to said cylinder of said engine as a partial function of said temperature of air proximate said engine;

means for comparing said actual magnitude of said quantity of air to said desired quantity of air;

means for determining, as a function of said operating speed and said command signal, a volumetric efficiency of air being supplied to said cylinder;

means for modifying said actual magnitude of said quantity of air as a function of said volumetric efficiency;

means for determining an error magnitude of air between said actual magnitude of said quantity of air and said desired quantity of air;

means for modifying said manually controlled command signal as a function of said error magnitude of air;

means for measuring a throttle position;

means for modifying said command signal when said command signal is generally equal to its maximum value and said throttle position is not generally equal to its maximum opened position.

* * * * *